US011794238B2

(12) United States Patent
Park et al.

(10) Patent No.: US 11,794,238 B2
(45) Date of Patent: Oct. 24, 2023

(54) MOLD FLUX AND CASTING METHOD USING SAME

(71) Applicant: POSCO, Pohang-si (KR)

(72) Inventors: Jun Yong Park, Pohang-si (KR); Tae In Chung, Pohang-si (KR); Seong Yeon Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 17/267,577

(22) PCT Filed: May 19, 2020

(86) PCT No.: PCT/KR2020/006540
§ 371 (c)(1),
(2) Date: Feb. 10, 2021

(87) PCT Pub. No.: WO2021/006476
PCT Pub. Date: Jan. 14, 2021

(65) Prior Publication Data

US 2022/0118506 A1 Apr. 21, 2022

(30) Foreign Application Priority Data

Jul. 11, 2019 (KR) ..... 10-2019-0084018

(51) Int. Cl.
*B22D 11/07* (2006.01)
*B22D 11/108* (2006.01)
(Continued)

(52) U.S. Cl.
CPC ..... *B22D 11/07* (2013.01); *B22D 11/108* (2013.01); *B22D 11/111* (2013.01); *C21C 7/076* (2013.01); *C22B 9/10* (2013.01)

(58) Field of Classification Search
None
See application file for complete search history.

(56) References Cited

U.S. PATENT DOCUMENTS 3,899,324 A * 8/1975 Corbett ..... C21C 7/076 148/26

FOREIGN PATENT DOCUMENTS

CN 101954464 1/2011
CN 102407306 4/2012
(Continued)

OTHER PUBLICATIONS

Chinese Office Action—Chinese Application No. 202080004889.4 dated Sep. 3, 2021, citing CN 102407306, CN 101954464, CN 103128243, JP4446359, JP 4389057, JP 4014001, and JP 3772111.
(Continued)

*Primary Examiner* — Scott R Kastler
(74) *Attorney, Agent, or Firm* — CANTOR COLBURN LLP

(57) ABSTRACT

Provided is a mold flux used for casing a cast slab, the mold flux including, bases on a total wt % of thereof, 32-38 wt % of aluminum oxide ($Al_2O_3$), 8-12 wt % of strontium oxide (SrO), 8-12 wt % of potassium oxide ($K_2O$), 8-12 wt % of fluorine (F), 5-8 wt % of boron oxide ($B_2O_3$), 3-5 wt % of lithium oxide ($Li_2O$), and inevitable impurities. Thus, according to the mold flux, a change in components due to silicon oxide ($SiO_2$) and calcium oxide (CaO) may be suppressed or prevented compared to those in the conventional art.

8 Claims, 2 Drawing Sheets

(51) Int. Cl.

| | |
|---|---|
| ***B22D 11/111*** | (2006.01) |
| ***C21C 7/076*** | (2006.01) |
| ***C22B 9/10*** | (2006.01) |

(56) References Cited

FOREIGN PATENT DOCUMENTS

| | | |
|---|---|---|
| CN | 103128243 | 6/2013 |
| JP | 3772111 | 5/2006 |
| JP | 4014001 | 11/2007 |
| JP | 4389057 | 12/2009 |
| JP | 4446359 | 4/2010 |
| JP | 2010125457 | 6/2010 |
| KR | 19930700235 | 3/1993 |
| KR | 20020044233 | 6/2002 |

OTHER PUBLICATIONS

International Search Report—PCT/KR2020/006540 dated Aug. 24, 2020.

PCT Written Opinion—PCT/KR2020/006540 dated Aug. 24, 2020, citing CN 101954464, JP 3772111, JP 4446359, KR 10-1993-0700235, JP 4014001, and JP 4389057.

* cited by examiner

MOLD FLUX AND CASTING METHOD USING SAME

TECHNICAL FIELD

The present invention relates to a mold flux and a casting method using the same, and more particularly, to a mold flux capable of improving quality and productivity of cast slabs and a casting method using the same.

BACKGROUND ART

The casting process is a process in which molten steel is put into a mold having an inner space with a predetermined shape, a semi-solidified cast slab is continuously drawn, and cast slabs having various shapes such as slabs, blooms, billets and beam blanks are manufactured.

During such a casting process, a mold flux is added to an upper portion of molten steel inside a mold, and the added mold flux is introduced into a gap between the mold and solidified shell. The introduced mold flux exerts an action on lubrication between the inner wall of the mold and the solidified shell or cast slab. In addition, aside from the lubrication action, the mold flux functions to absorb and melt non-metallic inclusions separated and floated from the molten steel, prevent reoxidation, and suppress heat dissipation, thereby keeping the temperature of the molten steel.

Meanwhile, electrical steel is a steel material in which the core loss is reduced that represents the amount of energy lost as heat during energy exchange between electricity and magnetism, and is a soft magnetic material manufactured to have superior electromagnetic properties than other steel materials. Such electrical steel is a steel material containing a high-content of aluminum (Al), and a high-aluminum (Al) content molten steel is used to manufacture the electrical steel.

However, during casting using high-aluminum content molten steel, silicon oxide ($SiO_2$), which is a main component of the mold flux, and aluminum (Al) in the molten steel react and cause a change in components in which the silicon oxide ($SiO_2$) content is decreased and the content of aluminum oxide ($Al_2O_3$) is increased. The aluminum oxide ($Al_2O_3$) in the mold flux, the components of which are changed, reacts with calcium oxide (CaO), silicon oxide ($SiO_2$), and sodium oxide ($Na_2O$) which are other components in the mold flux, and generates high-melting point crystal phases such as Ca—Al—O, Ca—Na—Al—O and Na—Al—Si—O.

In addition, due to the high-melting point crystal phases, the melting point and the viscosity of the mold flux abruptly increase and the fraction of a liquid phase in the melted mold flux is lowered. Therefore, a break out may be caused in which the introduction of the mold flux between the mold and the solidified shell is not smooth, or lubrication performance is not sufficient due to the mold flux having a low liquid phase fraction, and the solidified shell consequently bursts or is torn.

Accordingly, when conducting casting using molten steel containing a high content of aluminum (Al), the change in the components of the mold flux has been minimized through at least one among strict control of molten steel components, restriction in the quantity of continuous production of the cast slab, and casting speed control.

However, there is a problem in which when restricting the quantity of continuous production and casting speed of the cast slab, the quantity of production decreases. In addition, in case of electrical steel, a higher aluminum (Al) content is required in order to ensure low core loss and high magnetic field density, but there is problem in which the higher the aluminum (Al) content in molten steel, the greater the degree of component change in the mold flux.

RELATED ART DOCUMENTS (Patent Document 1) Korean Patent Publication KR 10-2002-0044233

DISCLOSURE OF THE INVENTION

Technical Problem

The present invention provides a mold flux capable of improving productivity of a cast slab and a casting method using the same.

The present invention provides a mold flux capable of ensuring lubrication performance and a casting method using the same.

Technical Solution

According to an embodiment of the present invention, a mold flux includes, bases on a total wt % of thereof, 32-38 wt % of aluminum oxide ($Al_2O_3$), 8-12 wt % of strontium oxide (SrO), 8-12 wt % of potassium oxide ($K_2O$), 8-12 wt % of fluorine (F), 5-8 wt % of boron oxide ($B_2O_3$), 3-5 wt % of lithium oxide ($Li_2O$), and inevitable impurities.

The mold flux does not include silicon oxide ($SiO_2$).

A melting point of the mold flux is 1,000-1,300° C.

The mold flux includes 9-10 wt % of the strontium oxide (SrO) based on a total weight thereof.

The mold flux includes 9-10 wt % of the potassium oxide ($K_2O$) based on the total weight thereof.

The mold flux includes calcium oxide (CaO), wherein a content of the calcium oxide (CaO) is adjusted so that a basicity ($CaO/Al_2O_3$) is 0.4 to 0.6.

The content of the calcium oxide (CaO) is adjusted so that a basicity ($CaO/Al_2O_3$) is 0.45 to 0.55.

The mold flux includes 5 wt % or less of sodium oxide ($Na_2O$).

According to an embodiment of the present invention, a casting method includes: preparing a mold flux; supplying molten steel to a mold; and putting the mold flux into an upper portion of the molten steel to cast a cast slab.

The molten steel includes 0.7 wt % or more of aluminum (Al) based on a total wt % of the molten steel.

The mold flux put into the upper portion of the molten steel is melted by heat of the molten steel and the melted mold flux has a viscosity of 0.5-3 poise.

In the casting of the cast slab, the mold flux introduced between a solidified shell formed from the molten steel and the mold, and in the mold flux introduced between the solidified shell and the mold, a ratio of an area occupied by a liquid phase is 70%-85% within a measurement area.

Advantageous Effects

According to a mold flux of an embodiment of the present invention, a change in components due to silicon oxide ($SiO_2$) and calcium oxide (CaO) may be suppressed or prevented compared to those in the conventional art.

In addition, in the mold flux according an embodiment, the contents of calcium oxide (CaO) and sodium oxide ($Na_2O$) are reduced compared to those in the conventional art, and a mold flux containing strontium oxide (SrO) and potassium oxide ($K_2O$) is prepared. Thus, the generation of high-melting point crystalline phases which degrade lubrication performance may be suppressed or prevented, occurrence of defects due to the mold flux may be prevented, and an operational accident such as a break out is prevented, so that a stable operation may be performed.

In addition, since the change in components and the generation of high-melting point crystalline phases are suppressed, the lubrication performance may be maintained even in a long term use. Accordingly, when the mold flux according to an embodiment is used, continuous casting may be stably performed for a long time. In addition, since a change in the components of the mold flux may be suppressed even without restricting the quantity of continuous production and casting speed of a cast slab, the quantity of production of the cast slab may be improved.

MODE FOR CARRYING OUT THE INVENTION

Figure 1:
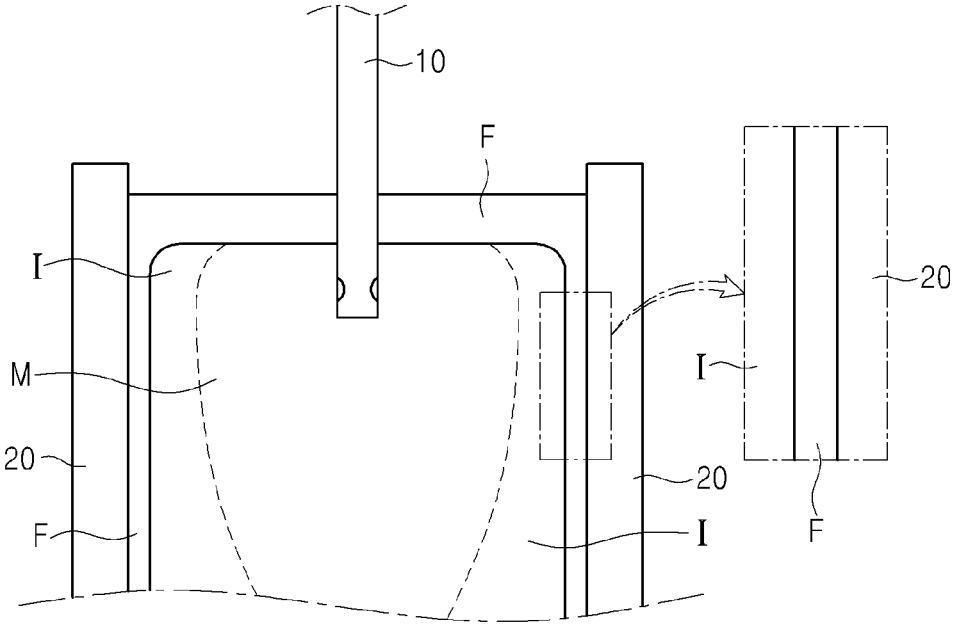
FIG. 1 is a view illustrating a state in which a mold flux is introduced during a casting process.

Hereinafter exemplary embodiments will be described in detail with reference to the accompanying drawings. However, the present invention may, however, be embodied in different forms and should not be construed as limited to the embodiments set forth herein. Rather, these embodiments are provided so that this disclosure will be thorough and complete, and will fully convey the scope of the present invention to those skilled in the art. To describe exemplary embodiments, drawings may be exaggerated and like reference numerals denote like elements in the drawings.

FIG. 1 is a view illustrating a state in which a mold flux is introduced during a casting process.

Referring to FIG. 1, a casting process is a process in which when molten steel M received in a turndish (not shown) is introduced into a mold 20 through a submerged nozzle, solidification of the molten steel M starts in the cooled mold and a semi-solidified state cast slab is obtained as an intermediate product.

During such a casting process, a mold flux F is put and melted on the molten steel M inside the mold 20, and the melted mold flux F is introduced into a gap between the mold 20 and a solidified shell I. The mold flux F introduced into the gap between the mold 20 and the solidified shell I flows downward together with the cast slab drawn downward from the mold 20 and is washed and consumed by cooling water sprayed to cool the case slab.

The mold flux F put into the mold 20 is a solid phase in a powder or granule state, and is melted by the heat of the molten steel when put to an upper portion of the molten steel M. In addition, the melted mold flux F is introduced into the gap between the mold 20 and the solidified shell I and performs a lubrication action.

In addition, when the mold flux has suitable lubrication performance, occurrence of break out, in which the solidified shell I bursts and is tom and the molten steel M leaks out, may be prevented. In addition, when the mold flux F has a suitable lubrication performance, the problem may be prevented in which the mold flux infiltrates into the inside of the solidified shell, that is, into the molten steel, and causes defect of cast slab.

The lubrication performance of the mold flux F is determined according to the melting point of the mold flux F, and the viscosity and liquid phase fraction of the mold flux put to the mold. Here, the liquid phase fraction of the mold flux F is represented by the ratio of the area occupied by the liquid phase in the measured area.

The present invention provides a mold flux that may ensure lubrication performance so that occurrence of break out or a cast slab defect is prevented or suppressed. At this point, in casting a cast slab using molten steel which contains a high content of aluminum Al, such as no less than 0.7 wt %, more favorably, no less than 1.0 wt %, an embodiment of the present invention provides a mold flux that may ensure lubrication performance.

Meanwhile, the temperatures of the molten steel and the melt surface of the molten steel loaded into the mold is approximately 1,300-1,350° C., and the temperature of the molten steel in a portion adjacent to the mold inner wall is approximately 1,000° C.

The mold flux in the powder or granule state is added to the melt surface of the molten steel and is melted by the heat of the molten steel, and is then introduced into a gap between the mold and the solidified shell. At this point, the mold flux may flow into the gap between the mold and the solidified shell only when the viscosity of the melted mold flux melted on the melt surface of the molten steel is ensured, and the lubrication performance between the mold and the solidified shell may be ensured only when the liquid phase fraction of the mold flux is ensured.

Accordingly, it is necessary to prepare a mold flux the viscosity of which is ensured at the temperature of 1,300-1,350° C., which is the temperature of the molten steel in the mold, and the liquid phase fraction of which is ensured at 1,000° C. which is the temperature of the molten steel adjacent to the mold inner wall.

In an embodiment of the present invention, there is provided a mold flux which has a viscosity of 0.5-3 poise at 1,300° C. and a liquid phase fraction of 70-85% at 1,000° C. In addition, since the viscosity and the liquid phase fraction of a mold flux varies according to the melting point of the mold flux, an embodiment of the present invention provides a mold flux having a melting point of 1,000-1,300° C.

Here, the meaning of 0.5-3 poise is 0.5 poise or higher and 3 poise or lower. In addition, in describing the viscosity, component content, liquid phase fraction and the like of the of a mold flux later, description is provided in a form of "lower limit value to upper limit value" and this means being "no less than the lower limit value and no greater than the upper limit value".

Meanwhile, when the melting point of the mold flux is less than 1,000° C. or the liquid phase fraction exceeds 85%, the lubrication performance of the mold flux is too large and the mold flux may be excessively introduced into the gap between the mold and the solidified shell. In this case, the mold flux may infiltrate into an inside of the solidified shell, that is, into the molten steel, and thus, a cast slab defect may be caused.

In addition, the molten steel is solidified by the mold being cooled, and at this point, the temperature of the mold is transferred to the solidified shell and the molten steel via the mold flux. However, when the liquid phase fraction of the mold flux exceeds 85%, heat transfer from the mold flux to the solidified shell or the molten steel is too great, and the thickness of the solidified shell may be too large in the mold.

In this case, when a semi-solidified cast slab is drawn out of the mold and is bent, and the cast slab may receive excessive stress and the quality thereof may be degraded.

In addition, when the melting point of the mold flux exceeds 1,300° C., or the liquid phase fraction is less than 70%, introduction of the mold flux through a gap between the mold and the solidified shell is insufficient, or the lubrication of the introduced mold flux may be insufficient. When the lubrication performance is insufficient as such, a break out in which the solidified shell bursts or is tom and the molten steel leaks may be caused, and thus, a problem may occur in which the molten steel pours down from the mold.

Accordingly, in an embodiment of the present invention, there is prepared a mold flux which has a viscosity of 0.5-3 poise at 1,300° C. and a liquid phase fraction of 70-85% at 1,000° C. More favorably, a mold flux is prepared which has a viscosity of 0.7-1.5 poise at 1,300° C. and a liquid phase fraction of 75-80% at 1,000° C.

Hereinafter, the components of a mold flux according to an embodiment of the present invention will be described in detail.

A mold flux according to an embodiment of the present invention may not include silicon oxide ($SiO_2$) which is a main reaction material with aluminum in the molten steel, but may include aluminum oxide ($Al_2O_3$), calcium oxide (CaO), strontium oxide (SrO), potassium oxide ($K_2O$), fluorine (F), boron oxide ($B_2O_3$), lithium oxide ($Li_2O$), and inevitable impurities. In addition, the mold flux may include sodium oxide ($Na_2O$) and magnesium oxide (MgO). Here, the mold flux may include inevitable impurities. That is, various unintended components may be included. Here, a state of including a trace of silicon oxide ($SiO_2$) is not excluded.

More specifically, a mole flux according to an embodiment may include, based on the total wt % thereof, 32-38 wt % of aluminum oxide ($Al_2O_3$), 8-12 wt % of strontium oxide (SrO), 8-12 wt % of potassium oxide ($K_2O$). In addition, the mold flux may include, based on the total wt % thereof, 8-12 wt % of fluorine (F), 5-8 wt % of boron oxide ($B_2O_3$), and 3-5 wt % of lithium oxide ($Li_2O$).

More favorably, strontium oxide (SrO) and potassium oxide ($K_2O$) may each be included in an amount of 9-10 wt %.

In addition, calcium oxide (CaO) functions to adjust the basicity ($CaO/Al_2O_3$) of the mold flux, and is added so that the basicity is 0.4 to 0.6. Here, since the content of aluminum oxide ($Al_2O_3$) is 32-38 wt %, calcium oxide may be prepared to have a content of 12.8-22.8 wt % so as to have 0.4-0.6 basicity ($CaO/Al_2O_3$). More favorably, the content of calcium oxide (CaO) may be adjusted so that the basicity is 0.45 to 0.55.

In addition, the mold flux may include 5 wt % or less of sodium oxide ($Na_2O$), 2 wt % of magnesium oxide (MgO). In addition, the mold flux may not include (0 wt %) at least one among sodium oxide ($Na_2O$) and magnesium oxide (MgO).

The mold flux according to such an embodiment of the present invention may have a melting point of 1,000-1,300° C., a viscosity of 0.5-3 poise at 1,300° C., and a liquid phase fraction of 70-85% at 1,000° C.

Aluminum oxide ($Al_2O_3$) is a neutral oxide and may act as base or acid according to the overall composition of the mold flux. Since there is no $SiO_2$ component in the corresponding composition, $Al_2O_3$ mainly act as an acidic oxide, serves as a main material in a hyaline structure inside the mold slag, and functions to allow the mold flux put to the molten steel to be in an amorphous or hyaline state.

Such aluminum oxide ($Al_2O_3$) may be contained, based on the total wt % of the mold flux, in a content of 32-38 wt % inclusive.

Here, when the content of aluminum oxide ($Al_2O_3$) is less than 32 wt %, the mold flux put into the molten steel may not be amorphized or insufficiently amorphized and the viscosity of the mold flux increases, and thus, desired lubrication performance may not be easily obtained.

Meanwhile, the aluminum oxide ($Al_2O_3$) in the mold flux reacts with at least one among the calcium oxide (CaO) and sodium oxide ($Na_2O$) in the mold flux to generate at least one high-melting point crystalline phase among Ca—Al—O based phases and Ca—Na—Al—O based phases, and thus the melting point of the mold flux abruptly increases. In addition, the mold flux is put into the molten steel in the mold and is melted, but there is a problem in which the greater the content of the high-melting point crystalline phases, the grater the viscosity of the mold flux.

Accordingly, when the content of aluminum oxide ($Al_2O_3$) exceeds 38 wt %, the amount of reaction between the calcium oxide (CaO) and the potassium oxide ($Na_2O$) in the mold flux increases, and thus, a great amount of high-melting point crystalline phases may be generated. Therefore, the melting point of the mold flux may be increased and the lubrication performance may thereby be degraded.

The content of calcium oxide (CaO) may be controlled so that the mold flux has basicity ($CaO/Al_2O_3$) of 0.4 to 0.6. When the basicity ($CaO/Al_2O_3$) of the mold flux is less than 0.4, the viscosity of the mold flux increases and introduction of the mold flux between the solidified shell and the mold decreases, and therefore an operation accident such as restrictive break out may be caused. In addition, when the basicity of the mold flux exceeds 0.6, the melting point of the mold flux rises, and the lubrication performance is degraded.

Fluorine (F) may be contained, based on the total wt % of the mold flux, in a content of 8-12 wt % inclusive. Meanwhile, when the content of fluorine (F) is less than 8 wt %, the viscosity of the mold flux increases and the lubrication may be degraded. Conversely, when the content of fluorine (F) exceeds 12 wt %, the viscosity of the mold flux is too low, and the lubrication performance may not be ensured. In addition, when the fluorine (F) exceeds 12 wt %, a great amount of HF may be generated by the reaction of fluorine and $H_2O$ during a casting operation using water as a cooling medium, and thus, corrosion of continuous casting equipment may be caused.

Boron oxide ($B_2O_3$) may be contained, based on the total wt % of the mold flux, in a content of 5-8 wt % inclusive. Boron oxide ($B_2O_3$) is a material having an effect of suppressing growth of high-melting point crystalline phases. However, when the content of boron oxide ($B_2O_3$) is less than 5 wt %, the effect of suppressing growth of crystalline phases, and thus, the melting point of the mold flux rises, the liquid phase fraction decreases, and it is difficult to ensure sufficient lubrication performance. In addition, when the content of boron oxide ($B_2O_3$) exceeds 8 wt %, the liquid phase fraction and the lubrication performance excessively increase. Thus, the mold flux may be excessively introduced into the gap between the mold and the solidified shell, and in this case, the mold flux may infiltrate into the inside of the solidified shell, that is, into the molten steel, and a cast slab defect may be caused. In addition, when the content of boron oxide ($B_2O_3$) exceeds 8 wt %, a slag rim may be caused in which the mold flux is solidified in a place adjacent to the inner wall of the mold in an upper region inside the mold. In addition, due to such a slag rim, a problem occurs in which a channel through which the mold flux is introduced between the mold and the solidified shell is narrowed.

Lithium oxide ($Li_2O$) is a component added to ensure a sufficient liquid phase fraction, and may be contained, based on the total wt % of the mold flux, in a content of 3-5 wt % inclusive. When the content of lithium oxide ($Li_2O$) is less than 3 wt %, the melting point of the mold flux is as high as 1,500° C. or higher, is not melted even at a temperature of 1,300° C., and thus, the liquid phase is absent at 1,000° C. or the liquid phase fraction is too low, and it is impossible to ensure lubrication performance. In addition, when the content of lithium oxide ($Li_2O$) exceeds 5 wt %, the melting point and the viscosity decreases compared to that when less than 3 wt %, and the liquid phase fraction increases, but the melting point exceeds 1,300° C. and the viscosity exceeds 3 poise, and thus it is difficult to ensure lubrication performance.

Magnesium oxide (MgO) may be contained, based on the total wt % of the mold flux, in a content of 2 wt % or less. Preferably, magnesium oxide (MgO) may not be contained (0 wt %). Meanwhile, magnesium oxide (MgO) may react with aluminum oxide ($Al_2O_3$) and form a high-melting point spinel phase including magnesium (Mg) and aluminum (Al). Accordingly, when the magnesium oxide (MgO) exceeds 2 wt %, a high-melting point spinel phase may be created in a great amount, and thus, there is a problem in which the melting point and the viscosity of the mold rises. Thus, magnesium oxide (MgO) is allowed to be contained, based on the total wt % of the mold flux, in a content of 2 wt % or less.

Meanwhile, if a conventional flux is used in casting a cast slab using molten steel containing high content of aluminum (Al), silicon oxide ($SiO_2$) in the mold flux reacts with aluminum (Al) in the molten steel, a change in the components occurs such that the content of silicon oxide in the mold flux decreases and the content of aluminum oxide ($Al_2O_3$) increases (see reaction formula).

$$SiO_2(\text{mold flux})+Al(\text{molten steel})\rightarrow Si(\text{molten steel})+Al_2O_3(\text{mold flux}) \quad \text{[Reaction formula]}$$

Conversely, the mold flux according to an embodiment is prepared so as not to include silicon oxide ($SiO_2$) that is the main component reacting with the aluminum (Al) in the molten steel. Accordingly, a change in the components of the mold flux may be suppressed or prevented compared to that in the related art.

In addition, conventional mold fluxes each contain 24 wt % of calcium oxide (CaO) or more and 6 wt % of sodium oxide ($Na_2O$). In addition, as described above, calcium oxide (CaO) and sodium oxide ($Na_2O$) in the mold flux react with aluminum oxide ($Al_2O_3$) to generate high-melting point crystalline phases such as Ca—Al—O and Ca—Na—Al—O.

However, when a high content of aluminum oxide ($Al_2O_3$) is contained in the mold flux, a high-melting point crystalline phase may be formed due to a reaction between at least one among calcium oxide (CaO) and sodium oxide ($Na_2O$) in the mold flux and the aluminum oxide ($Al_2O_3$). In addition, the melting point and the viscosity of the mold flux thereby increases and the liquid phase fraction decreases, so that a problem may be caused in which lubrication performance is degraded.

Accordingly, in producing the mold flux containing high-content of aluminum oxide ($Al_2O_3$), it is necessary to limit the contents of calcium oxide (CAO) and sodium oxide ($Na_2O$) which react with aluminum oxide ($Al_2O_3$) to generate a high-melting point crystalline phase.

Here, calcium oxide (CaO) should be included in the mold flux in order to adjust the basicity ($Cao/Al_2O_3$) of the mold flux to be 0.4-0.6 inclusive. However, since the generation of a high-melting point crystalline phase through a reaction with aluminum oxide ($Al_2O_3$) should be suppressed or decreased, the content of calcium oxide (CaO) is reduced compared to that in the conventional art.

At this point, since the content of calcium oxide (CaO) is adjusted so that the basicity ($CaO/Al_2O_3$) is 0.4-0.6 inclusive, the content of calcium oxide (CaO) may be 12.8-22.8 wt %, which is the content less than that in the conventional art.

As described above, sodium oxide ($Na_2O$) is a component which reacts with aluminum oxide ($Al_2O_3$) to generate a high-melting point crystalline phase, and in the embodiment, the mold flux is produced so as to have a reduced content of sodium oxide ($Na_2O$) compared to that in the conventional art and be produced so as to include 5 wt % or less of sodium oxide ($Na_2O$) based on the total wt % of the mold flux or not to include the sodium oxide ($Na_2O$). When the content of sodium oxide ($Na_2O$) exceeds 5 wt %, a great amount of high-melting point crystalline phases are generated through a reaction with aluminum oxide ($Al_2O_3$) and increases the melting point and the viscosity of the mold flux, and there is a problem in which lubrication performance may not be ensured.

As such, the reaction with the aluminum oxide ($Al_2O_3$) in the mold flux may be suppressed or reduced, by preparing the mold flux so that the contents of calcium oxide (CaO) and sodium oxide ($Na_2O$) are reduced or are zeros. Accordingly, even when the content of aluminum oxide ($Al_2O_3$) is high, the generation of the high-melting point crystalline phases may be suppressed through a reaction of at least one among calcium oxide (CaO) and sodium oxide ($Na_2O$) and aluminum oxide ($Al_2O_3$).

As such, since the contents of calcium oxide (CaO) and sodium oxide ($Na_2O$) are reduced, an alternative material for calcium oxide (CaO) and sodium oxide ($Na_2O$) is required. At this point, required is an alternative material which has smaller reactivity with aluminum oxide ($Al_2O_3$) than calcium oxide (CaO) and sodium oxide ($Na_2O$) and which may function to reduce the melting point and the viscosity of the mold flux.

The mold flux according to an embodiment include strontium oxide (SrO) and potassium oxide ($K_2O$), and these may be alternative materials that have similar functions as calcium oxide (CaO) and sodium oxide ($Na_2O$). More specifically, strontium oxide (SrO) is used as an alternative material for calcium oxide (CaO) and potassium oxide may be used as an alternative material for sodium oxide ($Na_2O$). Accordingly, generation of high-melting point crystalline phases such as Ca—Al—O and Ca—Ba—Al—O may be suppressed.

Here, as described above, strontium oxide (SrO) is a component put as an alternative material for calcium oxide (CaO), and has lower reactivity with the aluminum oxide ($Al_2O_3$) in the mold flux than calcium oxide (CaO). For example, when the same contents of strontium oxide (SrO) and calcium oxide (CaO) in the mold flux, the generated amount of high-melting point crystalline phases due to a reaction of strontium oxide (SrO) and aluminum oxide ($Al_2O_3$) is less than the generated amount of high-melting point crystalline phases due to a reaction of calcium oxide (CaO) and aluminum oxide ($Al_2O_3$). Accordingly, the generated amount of high-melting point crystalline phases may be reduced compared to that in the conventional art by reducing the content of calcium oxide (CaO) compared to that in the conventional and including strontium oxide (SrO).

In addition, as described above, potassium oxide ($K_2O$) is a component put as an alternative material for sodium oxide ($Na_2O$), and has lower reactivity with the aluminum oxide ($Al_2O_3$) in the mold flux than sodium oxide ($Na_2O$). For example, when the same contents of potassium oxide ($K_2O$) and sodium oxide ($Na_2O$) in the mold flux, the generated amount of high-melting point crystalline phases due to a reaction of potassium oxide ($K_2O$) and aluminum oxide ($Al_2O_3$) is less than the generated amount of high-melting point crystalline phases due to a reaction of sodium oxide ($Na_2O$) and aluminum oxide ($Al_2O_3$). Accordingly, the generated amount of high-melting point crystalline phases may be reduced compared to that in the conventional art by reducing the content of sodium oxide ($Na_2O$) and including potassium oxide ($K_2O$).

Strontium oxide (SrO) may be contained, based on the total wt % of the mold flux, in a content of 8-12 wt % inclusive. Meanwhile, when the content of strontium oxide (SrO) is less than 8 wt %, the effect of injection as an alternative material for calcium oxide is small. That is, strontium oxide (SrO) is a material put as an alternative material for calcium oxide (CaO), decreases the melting point and the viscosity, and increases the liquid phase fraction. However, in as state in which the content of calcium oxide (CaO) is reduced compared to that in the conventional art, when the content of strontium oxide (SrO) is as small as 8 wt % or less, there is a problem in which the melting point and the viscosity of the mold flux increases. In addition, the liquid phase fraction of the mold flux decreases due to the high melting point and viscosity, and therefore appropriate lubrication performance may be ensured. In addition, when the content of strontium oxide (SrO) exceeds 12 wt %, the melting point of the mold flux is as high as 1,500° C., so that there is a problem in which even when the mold flux is put to the upper portion of the molten steel, the mold flux is not melted.

Potassium oxide ($K_2O$) may be contained, based on the total wt % of the mold flux, in a content of 8-12 wt % inclusive. However, when the content of potassium oxide ($K_2O$) is less than 8 wt %, the effect of putting potassium oxide ($K_2O$) may be small. More specifically, potassium oxide ($K_2O$) is a component put as an alternative material for sodium oxide ($Na_2O$) and has the function to decrease the melting point and the viscosity of the mold flux. However, in as state in which the content of sodium oxide ($Na_2O$) is reduced compared to that in the conventional art, when the content of potassium oxide ($K_2O$) is as small as less than 8 wt %, there is a problem in which the melting point and the viscosity of the mold flux increases. In addition, the liquid phase fraction of the mold flux decreases due to the high melting point and viscosity, and therefore appropriate lubrication performance may not be ensured.

Conversely, when the content of potassium oxide ($K_2O$) exceeds 12 wt %, the melting point of the mold flux is as high as 1,500° C., so that there is a problem in which even when the mold flux is put to the upper portion of the molten steel, the mold flux is not melted. It is understood that this is because a great amount of high-melting point crystalline phases including aluminum (Al) is generated.

Hereinafter, a casting method according to an embodiment of the present invention will be described in detail with reference to FIG. 1. Here, overlapped descriptions on the above described description regarding the mold flux according to an embodiment will be omitted.

A casting method according to an embodiment of the present invention includes: preparing the mold flux, putting molten steel M into a mold 20, putting the mold flux to an upper portion of the molten steel M and casting a cast slab.

First, in the preparing the mold flux, bases on the total wt % of the mold flux, 32-38 wt % of aluminum oxide ($Al_2O_3$), 8-12 wt % of strontium oxide (SrO), 8-12 wt % of potassium oxide ($K_2O$), 8-12 wt % of fluorine (F), 5-8 wt % of boron oxide ($B_2O_3$), and 3-5 wt % of lithium oxide ($Li_2O$) are included in the mold flux.

In addition, in the mold flux, the content of calcium oxide (CaO) is adjusted so as to have a basicity ($CaO/Al_2O_3$) of 0.4 to 0.6, and the mold flux may include 0-5 wt % inclusive of sodium oxide ($Na_2O$), 0-2 wt % inclusive of magnesium oxide (MgO), and may include inevitable impurities.

In the preparing of the molten steel, molten steel which contains 0.7 wt % or more, more favorably 1.0 wt % or more, of aluminum (Al) based on the total wt % of the molten steel may be prepared through a refining process such as converter refining. In addition, the molten steel may be molten steel for producing electrical steel.

The preparing of the mold flux and the preparing of the molten steel are not in a relationship in time series, and, of course, either the mold flux or the molten steel may first be prepared, and the mold flux and the molten steel may simultaneously be prepared.

When the mold flux and the molten steel are prepared, the molten steel M is put into the mold 20 using the submerged nozzle 10 via a ladle and a turndish. In addition, when the molten steel M is put into the mold 20, the mold flux F is supplied to an upper portion of the molten steel M and a cast slab is cast.

At least a portion of the mold flux supplied to the upper portion of the molten steel M is melted, and the melted mold flux is introduced into a gap between the mold 20 and a solidified shell I, and thus, a cast slab is cast while the mold flux performs a lubrication action between the cast slab (solidified shell), only the surface of which is solidified, and the mold 20.

At this point, in the casting method according an embodiment of the present invention, the contents of calcium oxide (CaO) and sodium oxide ($Na_2O$) are reduced compared to those in the conventional art, and a mold flux containing strontium oxide (SrO) and potassium oxide ($K_2O$) are used. Accordingly, a change in the components of the mold flux may effectively be suppressed through a reaction between at least one among calcium oxide (CaO) and sodium oxide ($Na_2O$), and aluminum oxide ($Al_2O_3$).

In addition, generation of high-melting point crystalline phases such as Ca—Al—O and Ca—Ba—Al—O may be suppressed or reduced. Accordingly, lubrication performance may be ensured by suppressing increases in the melting point and viscosity and a decrease in the liquid phase fraction.

were recorded. In addition, when reaching 1,000° C., the areas occupied by liquid phases were calculated and derived in the recorded images.

The contents (wt %) of other components are the sum of the contents of magnesium oxide (MgO), iron oxide ($Fe_2O_3$), manganese oxide (MnO), phosphorous oxide ($P_2O_5$), and titanium oxide ($TiO_2$).

Table 1 shows the viscosities, melting points and liquid phase fractions according to first example and first to seventh comparative examples. Here, Table 1 is a table for comparing the characteristics of the mold fluxes according to whether containing strontium oxide (SrO).

TABLE 1

| division | CaO/ $Al_2O_3$ | $SiO_2$ (wt %) | CaO (wt %) | $Al_2O_3$ (wt %) | $Na_2O$ (wt %) | F (wt %) | $Li_2O$ (wt %) | $B_2O_3$ (wt %) | $K_2O$ (wt %) | SrO (wt %) | Other components (wt %) | Viscosity (poise) | Melting point (° C.) | Liquid phase fraction (%) |
|---|---|---|---|---|---|---|---|---|---|---|---|---|---|---|
| 1st comparative example | 0.6 | 14.7 | 24.8 | 38.4 | 7 | 7.8 | 7.2 | 0 | 0 | 0 | 0.1 | 4.63 | 1334 | 50 |
| 2nd comparative example | 0.9 | 16 | 26 | 30.3 | 10.7 | 11 | 1 | 2 | 0 | 0 | 3 | 1.98 | 1425 | 0 |
| 3rd comparative example | 0.9 | 17.3 | 28 | 31.2 | 3.5 | 11 | 5 | 2 | 0 | 0 | 2 | 1.82 | 1383 | 58 |
| 4th comparative example | 0.5 | 10.8 | 17.3 | 34 | 4.6 | 11 | 4.7 | 7.7 | 0 | 7.7 | 2.2 | 3.71 | 1222 | 70 |
| 5th comparative example | 0.7 | 7.6 | 23.2 | 34 | 0 | 11 | 4.7 | 7.7 | 4.6 | 4.8 | 2.4 | 1.8 | 1124 | 89 |
| 6th comparative example | 0.5 | 10.8 | 17.3 | 34 | 0 | 11 | 4.7 | 7.7 | 4.6 | 7.7 | 2.2 | 4.49 | 956 | 87 |
| 7th comparative example | 0.6 | 2.8 | 20 | 34 | 0 | 9.9 | 4.4 | 7.7 | 9.6 | 9.6 | 2 | 1.56 | 1147 | 87 |
| 1st example | 0.5 | 0 | 18.4 | 34 | 4.4 | 9.9 | 4.4 | 7.7 | 9.6 | 9.6 | 2 | 0.74 | 1237 | 79 |

Hereinafter, comparative examples and examples in which a cast slab is cast through a casting method according to an embodiment of the present invention will be described.

Tables 1 to 4 show the viscosities, melting points (° C.), and liquid phase fractions (5) of molten fluxes according to comparative examples and examples. Here, the mold fluxes according to comparative examples and examples all contain 30 wt % of aluminum oxide ($Al_2O_3$).

For experiments, the mold fluxes according to comparative examples and examples were prepared and the melting points, viscosities and liquid phase fractions thereof were measured.

Here, the melting points were measured for each of the mold fluxes according to comparative examples and examples using a heating microscope.

In addition, the viscosities were measured by a general viscometer at a temperature of 1,300° C. after heating each of the mold fluxes according to comparative examples and examples to the temperature of 1,300° C.

In addition, the liquid phase fractions of the mold fluxes according to comparative examples and examples were measured by a high-temperature confocal laser scanning microscope. More specifically, under the condition in which the mold fluxes were charged into a crucible, heated to 1,500° C., and cooled at a speed of 100° C./min, images of the processes of melting and solidifying the mold fluxes Referring to Table 1, the first example and the fourth to seventh comparative examples which include oxide strontium (SrO) has the melting point of 1,300° C. or lower, and the liquid phase fraction of 70% or more. However, in the first to third comparative examples which do not include strontium oxide, the melting point is high as much as exceeding 1,300° C., and the liquid phase fraction is low as much as 60 wt % or less. This is because the first to third comparative examples do not include strontium oxide (SrO) and have high contents of calcium oxide (CaO) as high as 24 wt %, so that a great amount of high-melting point liquid phases are generated due to a reaction with aluminum oxide ($Al_2O_3$) in the mold flux. Conversely, in the first example and fourth to seventh comparative examples, the mold flux is produced so as to include strontium oxide (SrO) and 23.2 wt % of calcium oxide (CaO), which is lower than those in first to third comparative examples. Accordingly, in the first example and the fourth to seventh comparative examples, the amount of generated high-melting point liquid phases due to a reaction with aluminum oxide ($Al_2O_3$) in the mold flux is relatively smaller than those in the first and third comparative examples, so that the mold flux has a low melting point and a high liquid fraction rate.

Comparing the first example and the fourth to seventh comparative examples which include strontium oxide (SrO), even when including strontium oxide (SrO), each of the viscosity, melting point and liquid phase fraction may or may not satisfy a target viscosity (0.5-3 poise), a target melting point (1,000-1,300° C., and a target liquid phase fraction (70-85%) according to the contents of components.

The composition of the mold flux according to the first example satisfies that the basicity ($CaO/Al_2O_3$) is 0.4-0.6, the aluminum oxide ($Al_2O_3$) content is 32-38 wt %, the sodium oxide ($Na_2O$) content is 5 wt % or less, the fluorine (F) content is 8-12 wt %, the lithium oxide ($Li_2O$) content is 3-5 wt %, the boron oxide ($B_2O_5$) content is 5-8 wt %, the potassium oxide ($K_2O$) content is 8-12 wt %, and the strontium oxide (SrO) content is 8-12 wt %, and aluminum oxide ($Al_2O_3$) is not included (zero wt %). Accordingly, in the first example, the viscosity is 0.74 poise and satisfies the range of 0.5-3 poise, the melting point is 1,237° C. and satisfies the range of 1,000-1,300° C., and the liquid phase fraction is 79 wt % and satisfies the range of 70-85 wt %.

Accordingly, when the mold flux according to the first example is put into molten steel in a mold, appropriate lubrication performance for the mold flux may be ensured. Thus, the occurrence of an operation accident such as break out caused by lack of lubrication performance of the mold flux and a cast slab defect due to excessive lubrication performance may be prevented.

Meanwhile, in the fifth comparative examples, the basicity ($CaO/Al_2O_3$) exceeds 0.6, but silicon oxide ($SiO_2$) is included, and the contents of potassium oxide ($K_2O$) and strontium oxide (SrO) are each as low as less than 8 wt %. Accordingly, the liquid phase fraction of the mold flux according to the fifth comparative example is as high as exceeding 85%.

In addition, in the fourth and sixth comparative examples, the basicity ($CaO/Al_2O_3$) satisfies 0.4-0.6, but silicon oxide ($SiO_2$) is included, and the contents of potassium oxide ($K_2O$) and strontium oxide (SrO) are each as low as less than 8 wt %. Accordingly, the viscosities in the fourth and sixth comparative examples both exceed 3 poise and the liquid phase fraction I the sixth comparative example exceeds 85%.

In addition, in the seventh comparative example, the basicity ($CaO/Al_2O_3$), aluminum oxide ($Al_2O_3$), sodium oxide ($Na_2O$), fluorine (F), lithium oxide ($Li_2O$), boron oxide ($B_2O_3$), potassium oxide ($K_2O$), and strontium oxide (SrO) all satisfy target ranges, but silicon oxide ($SiO_2$) is included. Accordingly, the liquid phase fraction in the seventh comparative example is 87 wt % and exceeds 85 wt %. In addition, the seventh comparative example includes silicon oxide ($SiO_2$), which is intentionally added during production of mold flux.

When the mold fluxes according to the fourth to seventh comparative examples are put into molten steel in a mold and a slab cast is cast, appropriate lubrication performance due to the mold flux may not be ensured. That is, introduction of the mold flux between the mold and a solidified shell is small, or the liquid phase fraction of the introduced mod flux is small, so that the lubrication performance may be insufficient. In this case, an operational accident such as a break out in which the solidified shell busts or is torn may be caused. In addition, an excessive amount of mold flux is introduced between the mold and the solidified shell, or the liquid phase fraction of the introduced mold flux is too large, so that the mold flux may be put into the molten steel inside the solidified shell to cause defects in the cast slab.

Figure 2:
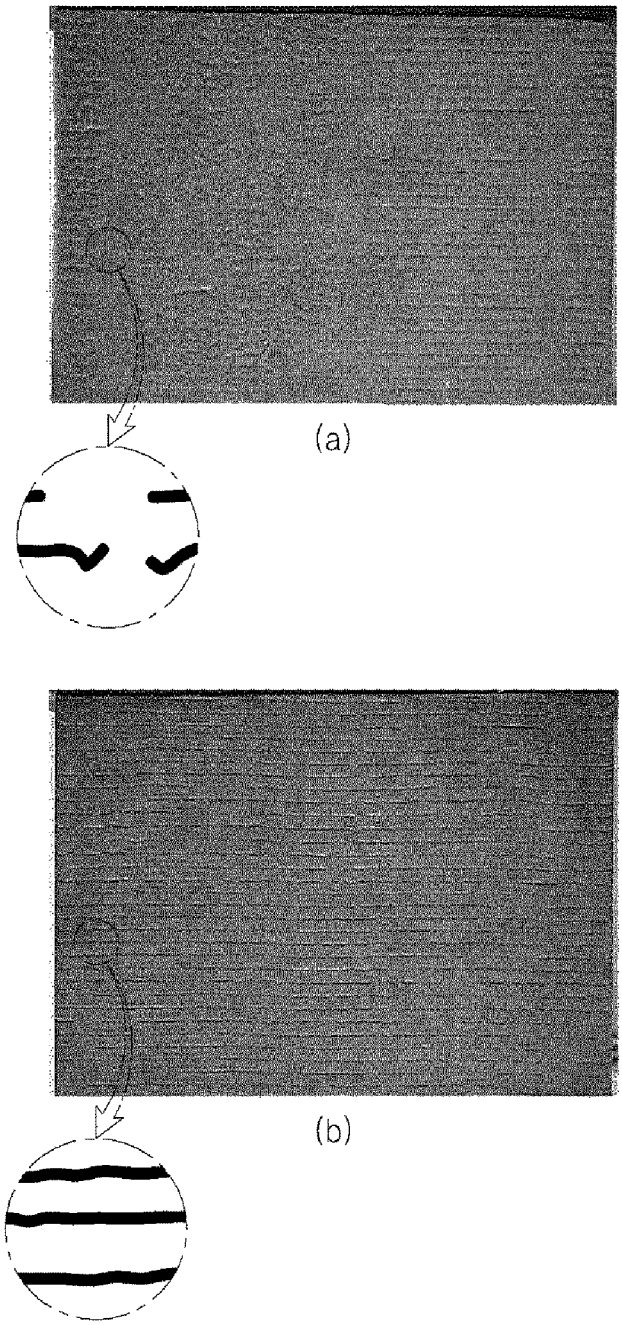
FIG. 2 shows (a) a photograph and a partial expanded view of a cast slab cast using a mold flux according to a second comparative example of Table 1, and (b) a photograph and a partial expanded view of a cast slab cast using a mold flux according to a first example of Table 1.

FIG. 2(*a*) shows a photograph and a partial expanded view of a cast slab cast using a mold flux according to the second comparative example of Table 1, and FIG. 2(*b*) shows a photograph and a partial expanded view of a cast slab cast using a mold flux according to the first example of Table 1.

When a cast slab is cast by supplying molten steel to a mold, the mold is caused to oscillate, and thus an oscillation OSM is formed on the surface of the cast slab.

However, in the case of the cast slab (FIG. 2(*a*)) manufactured by using the mold flux according to the second comparative example, oscillation marks OSM having uneven intervals or heights were formed. In addition, the area in which the oscillation marks are not continuously formed is large. This is because in case of the mold flux according to the second comparative example, the lubrication performance of the mold flux introduced between the mold and the solidified shell is not satisfactory. Conversely, in case of the cast slab (FIG. 2(*b*)) manufactured by using the mold flux according to the first example, oscillation marks OSM having even intervals or heights were formed. In addition, the area in which the oscillation marks are not continuously formed is smaller than that in FIG. 2(*a*). This is because in case of the mold flux according to the first example, the lubrication performance of the mold flux introduced between the mold and the solidified shell is satisfactory.

Table 2 shows the viscosities, melting points and liquid phase fractions according to second example and eight to 11th comparative examples. Here, Table 2 is a table for comparing the characteristics of mold fluxes according to the contents of potassium oxide ($K_2O$) and fluorine (F).

TABLE 2

| division | $CaO/Al_2O_3$ | $SiO_2$ (wt %) | CaO (wt %) | $Al_2O_3$ (wt %) | $Na_2O$ (wt %) | F (wt %) | $Li_2O$ (wt %) | $B_2O_3$ (wt %) | $K_2O$ (wt %) | SrO (wt %) | Other components (wt %) | Viscosity (poise) | Melting point (° C.) | Liquid phase fraction (%) |
|---|---|---|---|---|---|---|---|---|---|---|---|---|---|---|
| 8th comparative example | 0.4 | 0 | 18 | 43.3 | 5.5 | 6 | 5.6 | 9.6 | 0 | 9.3 | 2.6 | 5.39 | 1343 | 59 |
| 9th comparative example | 0.4 | 0 | 17.1 | 38.8 | 0 | 5.7 | 5 | 9.1 | 11 | 11 | 2.3 | 3.85 | 1287 | 71 |
| 10th comparative example | 0.5 | 0 | 20.1 | 37.9 | 0 | 7.4 | 4.1 | 5.7 | 11.9 | 9.9 | 3 | 3.2 | 1489 | 73 |

TABLE 2-continued

| division | $CaO/Al_2O_3$ | $SiO_2$ (wt %) | CaO (wt %) | $Al_2O_3$ (wt %) | $Na_2O$ (wt %) | F (wt %) | $Li_2O$ (wt %) | $B_2O_3$ (wt %) | $K_2O$ (wt %) | SrO (wt %) | Other components (wt %) | Viscosity (poise) | Melting point (° C.) | Liquid phase fraction (%) |
|---|---|---|---|---|---|---|---|---|---|---|---|---|---|---|
| $11^{th}$ comparative example | 0.6 | 0 | 21.1 | 35.8 | 0 | 14.3 | 4 | 5.4 | 10.5 | 0.9 | 3 | 0.47 | 1163 | 89 |
| $2^{nd}$ example | 0.5 | 0 | 17.9 | 36.6 | 0 | 11.7 | 4.2 | 6.4 | 10.8 | 9.2 | 3 | 0.84 | 1216 | 85 |

Referring to Table 2, the viscosities in the eighth and ninth comparative examples all exceed 3 poise, but an effect of reducing viscosity according to potassium oxide ($K_2O$) may be understood by comparing the viscosities. That is, it may be understood that compared to the eighth comparative example including sodium oxide ($Na_2O$) and no including potassium oxide ($K_2O$), the ninth comparative example not including sodium oxide ($Na_2O$) but including potassium oxide ($K_2O$) may have lower melting point and viscosity and a higher liquid phase fraction. In other words, it may be confirmed that the melting point and the viscosity decrease and the liquid phase fraction increases in the ninth comparative, in which sodium oxide ($Na_2O$) is not included and is replaced with potassium oxide ($K_2O$), compared to that in the eight comparative example in which case is different from that in the ninth comparative example. Accordingly, it may be understood that potassium oxide ($K_2O$) has an effect of increasing the lowering the melting point and the liquid phase fraction and increasing the liquid phase fraction.

In addition, in the second example, the viscosity (0.84 poise) satisfies the range of 0.5-3 poise, the melting point (1,216° C.) satisfies the range of 1,000-1,300° C., and the liquid phase fraction satisfies the range of 70-85%. In the composition of the components of the mold flux according to the second example, the basicity ($CaO/Al_2O_3$) satisfies the range of 0.4-0.6, silicon oxide ($SiO_2$) is not included, and aluminum oxide ($Al_2O_3$), sodium oxide ($Na_2O$), fluorine (F), lithium oxide ($Li_2O$), boron oxide ($B_2O_3$), potassium oxide ($K_2O$), and strontium oxide (SrO) satisfy the respective ranges However, in the 10th comparative example, the viscosity exceeds 3 poise and the melting point exceeds 1,300° C. In addition, in the 11th comparative example, the viscosity is less than 0.5 poise, and the liquid phase fraction exceeds 85%. In the composition of the components of the mold fluxes according to the 10th and 11th comparative examples, the basicity ($CaO/Al_2O_3$) satisfies the range of 0.4-0.6, silicon oxide ($SiO_2$) is not included, and aluminum oxide ($Al_2O_3$), sodium oxide ($Na_2O$), lithium oxide ($Li_2O$), boron oxide ($B_2O_3$), and potassium oxide ($K_2O$) satisfy the respective ranges However, in the 10th comparative example, the fluorine (F) content is less than 8 wt %, and in the 11th comparative example, the fluorine content exceeds 12 wt %. Accordingly, the viscosity in the 10th and 11th comparative examples, the viscosities are low as less than 0.5 poise, or is as high as exceeding 3 poise.

Table 3 shows the viscosities, melting points and liquid phase fractions according to the third example and the 12th to 13th comparative examples. Here, Table 3 is a table for comparing the characteristic of the mold flux according to the content of boron oxide ($B_2O_3$).

TABLE 3

| Division | $CaO/Al_2O_3$ | $SiO_2$ (wt %) | CaO (wt %) | $Al_2O_3$ (wt %) | $Na_2O$ (wt %) | F (wt %) | $Li_2O$ (wt %) | $B_2O_3$ (wt %) | $K_2O$ (wt %) | SrO (wt %) | Other components (wt %) | Viscosity (poise) | Melting point (° C.) | Liquid phase fraction (%) |
|---|---|---|---|---|---|---|---|---|---|---|---|---|---|---|
| $12^{th}$ comparative example | 0.6 | 0 | 23 | 37.1 | 0 | 9.6 | 4.8 | 3.8 | 7.6 | 11.1 | 3 | 2.7 | 1337 | 67 |
| $13^{th}$ comparative example | 0.6 | 0 | 20.6 | 34 | 0 | 10.1 | 4.7 | 9.1 | 8.5 | 10.8 | 2.2 | 1.65 | 1134 | 90 |
| $3^{rd}$ example | 0.6 | 0 | 22 | 34 | 0 | 10.2 | 4.7 | 7.5 | 8.2 | 11.2 | 2.2 | 2 | 1234 | 83 |

In a third example, viscosity (2 poise) satisfies the range of 0.5-3 poise, the melting point (1,234° C.) satisfies the range of 1,000-1,300° C., and the liquid phase fraction (83%) satisfies the range of 70-85%. In addition, the mold flux according to the third example, the basicity ($CaO/Al_2O_3$) satisfies the range of 0.4-0.6, silicon oxide ($SiO_2$) is not included, and aluminum oxide ($Al_2O_3$), sodium oxide ($Na_2O$), fluorine (F), lithium oxide ($Li_2O$), boron oxide ($B_2O_3$), potassium oxide ($K_2O$), and strontium oxide (SrO) satisfy the respective ranges.

However, in the 12th comparative example, the melting point exceeds 1,300° C. and the liquid phase fraction is less than 70%. In addition, the liquid phase fraction exceeds 85% in the 13th comparative example. In the composition of the components of the mold fluxes according to the 12th and 13th comparative example, the basicity ($CaO/Al_2O_3$) satisfies the range of 0.4-0.6, silicon oxide ($SiO_2$) is not included, and aluminum oxide ($Al_2O_3$), sodium oxide ($Na_2O$), fluorine (F), lithium oxide ($Li_2O$), and strontium oxide (SrO) satisfy the respective ranges. However, in the 12th comparative example, boron oxide ($B_2O_3$) content is less than 5 wt %, and the boron oxide ($B_2O_3$) content exceeds 8 wt % in the 13th comparative example. Accordingly, in the 12th comparative example, the liquid phase fraction is 67% which is less than 70%, the lubrication performance thereby lacks lubrication performance. In addition, in the 13th comparative example, the liquid phase fraction is 90% which exceeds 85% and there is a problem of too high lubrication performance.

Table 4 shows the viscosities, melting points and liquid phase fractions according to the fourth example and the 14th to 15th comparative examples. Here, Table 4 is a table for comparing the characteristic of a mold flux according to the content of lithium oxide ($Li_2O$).

TABLE 4

| Division | $CaO/Al_2O_3$ | $SiO_2$ (wt %) | CaO (wt %) | $Al_2O_3$ (wt %) | $Na_2O$ (wt %) | F (wt %) | $Li_2O$ (wt %) | $B_2O_3$ (wt %) | $K_2O$ (wt %) | SrO (wt %) | Other components (wt %) | Viscosity (poise) | Melting point (° C.) | Liquid phase fraction (%) |
|---|---|---|---|---|---|---|---|---|---|---|---|---|---|---|
| $14^{th}$ comparative example | 0.6 | 0 | 24.8 | 38.2 | 4.6 | 11.7 | 2.3 | 5.7 | 0 | 9.3 | 3 | — | 1,500° C. or higher | 0 |
| $15^{th}$ comparative example | 0.4 | 0 | 14.8 | 33.8 | 5 | 11.3 | 9.1 | 5.3 | 10.1 | 8.2 | 2 | 3.17 | 1392 | 71 |
| $4^{th}$ example | 0.6 | 0 | 21.1 | 32.5 | 4.4 | 10.4 | 4.7 | 6.3 | 9.9 | 8.5 | 2 | 2.75 | 1283 | 70 |

Referring to Table 4, In the fourth example, viscosity (2.75 poise) satisfies the range of 0.5-3 poise, the melting point (1,283° C.) satisfies the range of 1,000-1,300° C., and the liquid phase fraction (70%) satisfies the range of 70-85%. In addition, in the mold flux according to the fourth example, the basicity ($CaO/Al_2O_3$) satisfies the range of 0.4-0.6, silicon oxide ($SiO_2$) is not included, and aluminum oxide ($Al_2O_3$), sodium oxide ($Na_2O$), fluorine (F), lithium oxide ($Li_2O$), boron oxide ($B_2O_3$), potassium oxide ($K_2O$), and strontium oxide (SrO) satisfy the respective ranges.

Meanwhile, in the 14th comparative example, the melting point is 1,500° C. or higher, so that it is impossible to measure the viscosity at 1,300° C., and the liquid phase fraction at 1,000° C. is 0%. In addition, in the 15th comparative example, the liquid phase fraction satisfies the range of 70-85%, but the melting point exceeds 1,300° C., and the viscosity exceeds 3 poise. It is understood that this is because in the 14th comparative example, the lithium oxide ($Li_2O$) content is less than 3 wt %, and in the 15th comparative example, the lithium oxide ($Li_2O$) content exceeds 5 wt %.

As described above, according to the mold flux of an embodiment of the present invention, a change in components due to silicon oxide ($SiO_2$) and calcium oxide (CaO) may be suppressed or prevented compared to those in the conventional art. In addition, the contents of calcium oxide (CaO) and sodium oxide ($Na_2O$) are reduced compared to those in the conventional art, and a mold flux containing strontium oxide (SrO) and potassium oxide ($K_2O$) are prepared.

Thus, the occurrence of generation of high-melting point crystalline phases which degrade lubrication performance may be suppressed or prevented, occurrence of defects due to the mold flux may be prevented, and an operational accident such as a break out is prevented, so that a stable operation may be performed.

In addition, since the occurrence of a change in components and high-melting point crystalline phases are suppressed, the lubrication performance may be maintained even in a long term use. Accordingly, when the mold flux according to an embodiment is used, continuous casting may be stably performed for a long time. In addition, since a change in the components of the mold flux may be suppressed even without restricting the casting speed and the quantity of continuous production of a cast slab, the quantity of production of the cast slab may be improved.

INDUSTRIAL APPLICABILITY

According to the mold flux of an embodiment of the present invention, a change in components due to silicon oxide ($SiO_2$) and calcium oxide (CaO) may be suppressed or prevented compared to those in the conventional art. In addition, in the mold flux according an embodiment, the contents of calcium oxide (CaO) and sodium oxide ($Na_2O$) are reduced compared to those in the conventional art, and a mold flux containing strontium oxide (SrO) and potassium oxide ($K_2O$) is prepared. Thus, the occurrence of generation of high-melting point crystalline phases which degrade lubrication performance may be suppressed or prevented, occurrence of defects due to the mold flux may be prevented, and an operational accident such as a break out is prevented, so that a stable operation may be performed.

What is claimed is:

1. A mold flux used for casing a cast slab, the mold flux comprising, based on a total wt % of thereof, 32-38 wt % of aluminum oxide ($Al_2O_3$), 8-12 wt % of strontium oxide (SrO), 8-12 wt % of potassium oxide ($K_2O$), 8-12 wt % of fluorine (F), 5-8 wt % of boron oxide ($B_2O_3$), 3-5 wt % of lithium oxide ($Li_2O$), and inevitable impurities.

2. The mold flux of claim 1, not comprising silicon oxide ($SiO_2$).

3. The mold flux of claim 2, wherein a melting point of the mold flux is 1,000-1,300° C.

4. The mold flux of claim 1, comprising 9-10 wt % of the strontium oxide (SrO) based on a total weight thereof.

5. The mold flux of claim 1, comprising 9-10 wt % of the potassium oxide ($K_2O$) based on the total weight thereof.

6. The mold flux of claim 1 comprising calcium oxide (CaO), wherein a content of the calcium oxide (CaO) is adjusted so that a basicity ($CaO/Al_2O_3$) is 0.4 to 0.6.

7. The mold flux of claim 6, wherein the content of the calcium oxide (CaO) is adjusted so that the basicity($CaO/Al_2O_3$) is 0.45 to 0.55.

8. The mold flux of claim 1, comprising 5 wt % or less of sodium oxide ($Na_2O$).

* * * * *